United States Patent [19]

Cox

[11] Patent Number: 4,876,483

[45] Date of Patent: Oct. 24, 1989

[54] ARC LAMP WITH SURFACE ARC RESISTANT BARRIER

[75] Inventor: David A. Cox, Lexington, Ky.

[73] Assignee: GTE Products Corporation, Danvers, Mass.

[21] Appl. No.: 199,233

[22] Filed: May 26, 1988

[51] Int. Cl.[4] ..... H01J 61/10; H01J 61/30

[52] U.S. Cl. ..... 313/634; 313/610; 313/242; 313/317; 313/326

[58] Field of Search ..... 313/610, 634, 25, 242, 313/326, 317

[56] References Cited

U.S. PATENT DOCUMENTS

| | | | |
|---|---|---|---|
| 1,963,961 | 6/1934 | Barclay | 170/138 |
| 1,985,028 | 12/1934 | Gehrts | 250/27.5 |
| 2,329,019 | 9/1943 | Wagener | 250/27.5 |
| 2,454,384 | 11/1948 | Henry | 250/27.5 |
| 3,906,275 | 9/1975 | Spiessens et al. | 313/318 |
| 4,302,699 | 11/1981 | Keeffe et al. | 313/634 |
| 4,308,483 | 12/1981 | Keeffe et al. | 313/634 |
| 4,320,322 | 3/1982 | Rothwell, Jr. et al. | 313/349 |
| 4,321,504 | 3/1982 | Keeffe et al. | 313/634 |
| 4,415,829 | 11/1983 | Rothwell, Jr. et al. | 313/621 |
| 4,454,450 | 6/1984 | English et al. | 313/620 |
| 4,557,700 | 12/1985 | Rothwell, Jr. et al. | 445/53 |
| 4,612,000 | 9/1986 | English et al. | 445/6 |
| 4,620,130 | 10/1986 | Keeffe et al. | 313/634 |
| 4,636,687 | 1/1987 | Keeffe et al. | 313/620 |
| 4,658,177 | 4/1987 | Gosslar et al. | 313/25 |
| 4,668,204 | 5/1987 | English et al. | 445/26 |

*Primary Examiner*—Kenneth Wieder
*Attorney, Agent, or Firm*—William E. Meyer

[57] ABSTRACT

An arc discharge lamp resistant to surface path arcing may be formed by press sealing a dielectric barrier between the electrode roots. By properly manipulating the press seal, a barrier of the dielectric envelope material may be positioned between the electrode roots. The barrier lengthens the discharge path between the electrode roots, and thereby resists surface arc discharge. The lamp seal is then protected from surface discharge heating, and light generation properly occurs between the electrode tips.

6 Claims, 1 Drawing Sheet

ARC LAMP WITH SURFACE ARC RESISTANT BARRIER

TECHNICAL FIELD

The invention relates to electric lamps and particularly to arc discharge electric lamps. More particularly the invention is concerned with single ended arc discharge electric lamps having a dielectric barrier intermediate the electrodes for limiting surface arc over between the electrodes.

BACKGROUND ART

Arc discharge lamps operate by jumping an electric arc between two displaced electrodes. The electric arc excites the atoms of a gas along the arc path to high energy states resulting in light and heat. Arcing ideally occurs directly between the electrode tips, which is generally accomplished by making the gap between the electrode tips the smallest distance between the electrodes. In single ended arc tubes, the electrodes are substantially side by side and parallel. The tip to tip distance may then be reduced by angling the electrodes towards each other, as seen in U.S. Pat. Nos. 4,557,700 to Rothwell et al or in 4,612,000 to English et al. Another method is to bend the tips over as seen in U.S. Pat. Nos. 4,415,829 to Rothwell, Jr et al. or 4,308,483. A feature may be created on the electrode end, such as a ball or loop (see U.S. Pat. No. 4,320,322 Rothwell Jr. et al.) to narrow the distance interelectrode distance. Theoretically, arcing is then most likely to occur at the tips. The arc path is then at the electrode tips, well away from the envelope wall.

Despite the methods of angling and bending the electrodes, straight electrodes are still used for ease of manufacture, cost, alignment and other more practical reasons, particularly for mall volume lamps, as for example seen in U.S. Pat. No. 4,321,504 to Keefe et al.

A problem in single ended arc lamps is arcing misplaced from the electrode tips. In particular, arcing can move from the electrode tips, to the electrode roots, where the electrodes emerge from the envelope material. Arcing at the electrode roots occurs particularly during a hot restart of the lamp. A surface effect makes arcing along the envelope surface easier than in the open volume between the electrode tips. The surface effect is thought to result from a lower molecular activity in the gas near the envelope surface which lowers electrical resistance, and from the molecular alignment of the envelope surface material which allows electrons to be given up more easily which also lowers resistance. Due to the small enclosed volume in smaller arc capsules, the electrode placement and separation is limited. As a result, the surface effect cannot always be fully offset by separating or angling the electrodes. Small lamps in particular are then more subject to surface arcing at the seal area instead of at the electrode tips.

Discharge between the electrode roots is undesirable for at least two reasons. First, the arc is moved from the expected point of formation. The resulting light is then offset from the light path planned for focusing and projection. Second, the heat loading of the envelope adjacent the arc discharge is increased, and may rise above the material limit for the envelope. The lamp can then fail in the electrode root area due to the excess heating by the surface arcing.

DISCLOSURE OF THE INVENTION

An arc discharge lamp may be formed with a surface arc resistant barrier from an envelope formed of a radiant energy transmissive material defining by an interior surface an enclosed volume with an included fill gas, two arc discharge electrodes generally side by side having root portions emerging from the interior surface defining an electrode separation distance and projecting for a distance into the enclosed volume, two electrode connections leading from the exterior of the envelope to electrically join the electrodes, and a dielectric barrier formed along the interior surface of the envelope and between the electrode roots and extending into the gas filled volume for a distance less than the electrode projection distance thereby establishing a dielectric barrier between the electrodes.

BEST MODE FOR CARRYING OUT THE INVENTION

Figure 1:
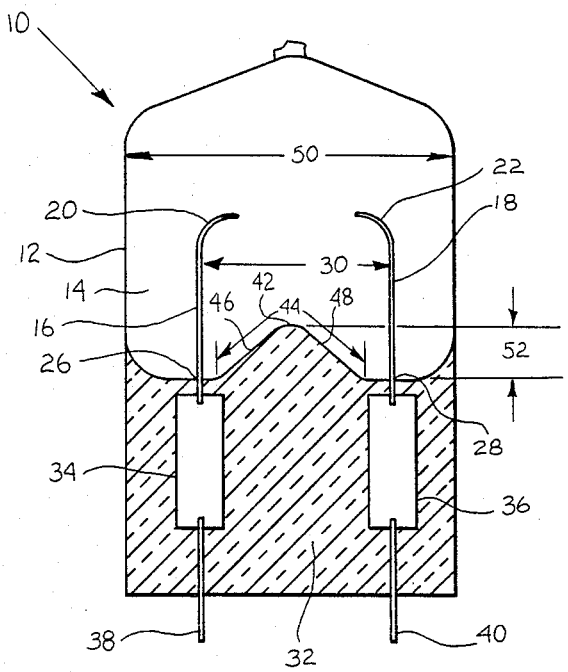
FIG. 1 shows in cross section a preferred embodiment of an arc lamp with a surface arc resistant barrier.

FIG. 1 shows a preferred embodiment of a surface arc resistant lamp 10. Surface arc resistant lamp 10 includes an envelope 12 of light transmissive material defining an enclosed volume 14, two electrodes 16, 18 positioned to extend electrode tips 20, 22 in the enclosed volume 14. Electrical connections from the exterior of the envelope 12 connect to the electrodes 16, 18 to power an electric arc between the electrode tips 20, 22. By way of example an arc discharge lamp 10 is shown as a high voltage discharge lamp, although the teaching here may be applied to arc lamps of any other suitable cross sectional configuration.

The envelope 12 for arc discharge lamps may be formed from radiant energy transmissive materials such as fused silica, glass, alumina and others known in the art. Some of these materials are melt formable by application of gas pressure, or mechanical force. Typically a general form, such as a tube, is made, and subsequently closed off by heating the material and either tipping off or press sealing the open areas to enclose the envelope volume 14. The typical volume 14 may range from (0.1 ml to 0.1 liter), but larger and smaller volumes are possible. The actual volume chosen depends on the light output sought from the lamp, the electrode size and separation, and the ability of the envelope material to withstand the resulting heat loading. The enclosed volume 14 of an arc discharge tube is commonly filled with a gas chosen for its particular discharge reaction to an electric arc. Examples of such gas fills are inert gases such as argon, xenon or neon. Additions of excitable materials such as mercury and iodides of sodium, scandium, tin and others as are known in the art are included in the fill gas to enhance light generation. The particular gas fill is not felt to be significant with the respect to applicant's teaching.

The electrodes 16, and 18 are typically metal rods projecting into the gas volume. The rods are positioned so the nearest points between the electrodes 16, 18 are the innermost tips 20, 22. Electric discharge is then encouraged to occur between the electrodes 16, 18 from tip 20 to tip 22. Similarly, to discourage discharge adjacent the envelope 12, between where the electrodes emerge from the envelope material as the electrode roots 26, 28, the surface path distance 30 between the roots 26, 28 is preferably made as large as possible.

The electrical connections are made between the exterior of the envelope 12 and the electrodes 16, 18. A common method of connection may be made by connecting the electrodes 16, 18 to metal foils 34, 36, commonly molybdenum foils, which are in turn connected to exit wires 38, 40. The electrode to foil and foil to exit wire connections are commonly captured in the envelope material during press sealing. The surrounding envelope 12 may be heated to a softened state with the electrodes 16, 18, foils 34, 36 and exit wires 38, 40 positioned in the encompassing softened zone of the envelope. Clamps press the softened envelope material from opposite sides of the connection elements. The softened envelope material seals around the connection elements forming the press seal 32. The electrode tips 20, 22 project into the enclosed volume 14, while the electrode roots 26, 28 are partially captured in the interior envelope surface material. The foils 34, 36 are completely entrained in the envelope material to expand and contract with the envelope 12 and thereby not break the gas seal made with the envelope material. The exit wires 38, 40 are partially captured in the exterior surface of the envelope 12, and extend to the envelope 12 exterior for electrical connection.

In the preferred arc lamp embodiment, formed along the interior surface of the envelope volume 14, and intermediate the electrode roots 26, 28 is a barrier 42. The barrier 42 is formed from a substantially nonconductive dielectric material, and is shaped and positioned to reduce the likelihood of arcing adjacent the envelope 12 surface between the electrode roots 26, 28. The optimal barrier 42 form has not been determined by the applicant, however a number of aspects are preferred. The contour along the barrier 42 between the electrode roots 26, 28 defining the surface path 44 is generally preferred to be a longer path than a shorter path. A single barrier 42 having faces 46, 48 opposite the electrodes 16, 18 with face angles of about 45° to the electrodes 16, 18 is preferred, although a generally useful range is thought to be from about 30° to 60° Barrier face angles of more than 60° progressively lead to a level and therefore relatively short surface path 44 and are therefore progressively less preferred. Barrier face angles of less than 30° are progressively more difficult to form, potentially protrude into the arc zone, and may lead to a weakened seal area, and are therefore progressively less preferred. The form of the barrier is not limited to a triangular hill structure, but may be any solid projection of dielectric material interposed between the electrodes.

A surface barrier 42 may be conveniently formed between the electrode roots 26, 28 by specially shaping the press seal clamps. Normally, press seal clamps with flat faces and top edge contours perpendicular to the electrode roots 26, 28 are used to press and seal the softened envelope material around the electrode roots 26, 28. Clamps with perpendicular top edge contours then leave a straight surface path between the electrode roots 26, 28 along which the surface effect arcing may occur. The preferred method of making the barrier 42 is to use clamps with top edge contours, at least in the area between the electrodes 16, 18, angled to the electrode roots 26, 28 in the direction of the envelope volume 14. As the clamps close, a portion of the softened envelope material between the electrode roots 26, 28 is forced to project into the internal envelope volume 14. The light transmissive material commonly used for arc lamps is quartz, a substantially dielectric material, which is normally worked at about 1700° C. Quartz at 1700° C. is sufficiently fluid to adequately flow under the force of the clamps around the electrodes 16, 18. To form the barrier 42, a still greater fluidity in the envelope material may be useful, and therefore an increased pressing temperature may be preferred. In one example, a temperature increase of about 200° C. to 1900° C. was used to gain greater fluidity.

On cooling, the projected volume remains in position between the electrode roots 26, 28 thereby forming a dielectric surface arc barrier 42. The barrier 42 interposes a nonconductive material directly between the electrode roots 26, 28, thereby frustrating direct arc over, and substantially lengthens the surface path 44 length, thereby increasing the arc over voltage required to cause arcing along the longer surface path 44.

A wall or a shaped wall are alternative barriers forms. An alternative method is to use clamps with protuberances on the clamp faces 46, 48, at least in the area closing between the electrodes 16, 18. The protuberances press the seal area 32 somewhat thinner in the area between the electrodes 16, 18, with the displaced envelope material being forced outwards between the electrode roots 26, 28 to form the barrier 42. In a still further alternative, the barrier 42 may be formed by first making a standard flat press, and subsequently making a second small press between the electrode roots 26, 28 to urge the envelope material into a barrier 42. A further alternative, is to preposition a barrier 42 structure, such as a ceramic piece coupled between the electrode roots 26, 28. The prepositioned or coupled barrier 42 structure may then be partially captured in the envelope 12 wall during the press sealing of the electrodes, and thereby be securely positioned.

Figure 2:
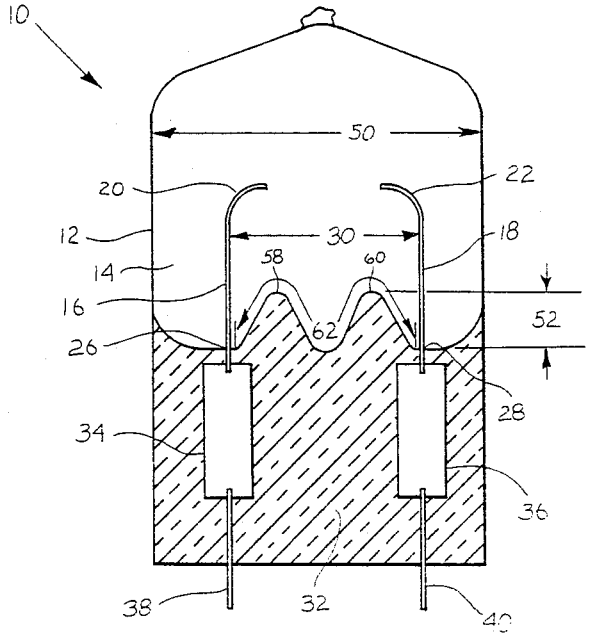
FIG. 2 shows in cross section an alternative preferred embodiment of an arc lamp with multiple surface arc resistant barriers.

FIG. 2 shows in cross section an alternative embodiment of a surface arc resistant arc lamp. Between the electrode roots 26, 28, multiple barriers 56, 58 may be formed. Where the projection of a single barrier into the envelope volume 14 might interfere with arcing between the tips 20, 22. A multiplicity of barriers 56, 58 may be difficult to form, and the line between the electrodes 16, 18 and tipping the top of each barrier 56, 58 may act as a single straight surface path 44 running directly between the electrode roots 26, 28. Similarly, sharp valleys 60 formed between the barriers 56, 58 are thought to be of likely utility with some rounding off of the surface path expected at the valley bottom.

In a working example of an arc discharge lamp with a surface path resistant barrier, some of the dimensions were approximately as follows: The envelope was about 7.62 mm (0.3 inch) in outside diameter, and enclosed a volume of 0.2 ml. Tungsten electrodes about 10.16 mm (0.4 inch) long extended about 4.31 mm (0.17 inch) into the enclosed volume. The distance across the internal volume from the electrode root to the tip off was about 8.89 mm (0.35 inch). The electrodes were separated, center to center, by about 1.0 or 1.5 mm (0.039 to 0.059 inch). The root to root separation between the electrodes was about 2.0 or 3.0 mm (0.078 to 0.118 inch). The barrier had a width of about 3.0 mm (0.078 inch) and a height of about 1.5 mm (0.059 inch). The press seal was about 12.70 mm (0.5 inch) long with the enclosed foils being about 7.62 mm (0.3 inch) long. The disclosed operating conditions, dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. An arc discharge lamp with a surface arc resistant barrier comprising:

(a) an envelope formed of a nonconductive radiant energy transmissive mate rial defining by an interior surface on enclosed volume with an included fill gas, (b) two arc discharge electrodes generally side by side having root portions positioned in and separated only by nonconductive material, and emerging from the interior surface defining an electrode separation distance and projecting for a distance into the enclosed volume, (c) two electrode connections leading from the exterior of the envelope to electrically join the two respective electrodes, and (d) at least two dielectric barriers formed along the interior surface of the envelope and between the electrode roots and extending into the enclosed volume for a distance less than the electrode projection distance thereby establishing a dielectric barrier between the electrodes.

2. The apparatus in claim 1, wherein the barriers are formed from the envelope material.

3. The apparatus in claim 1, wherein the barriers extend into the enclosed volume for a distance of approximately one half the electrode separation distance.

4. The apparatus in claim 1, wherein at least one of the barriers includes a face opposite one of the electrodes forming an angle with the electrode in the approximate range of 30° to 60°.

5. The apparatus in claim 4, wherein the barrier's face angles formed between one of the electrodes and an opposite barrier face is approximately 45°.

6. An arc discharge lamp with a surface arc resistant press seal comprising:

(a) envelope formed of a nonconductive radiant energy transmissive material defining by an interior surface an enclosed volume filled with a gas and including a press seal area sealing two generally side by side electrodes separated only by nonconductive material, and projecting into the gas filled volume, (b) electrode connections leading from the exterior of the envelope to electrically join the two respective electrodes, and (c) at least two barriers formed from the envelope material, formed in the area between the electrode roots and extending into the gas filled volume for a distance less than the electrode separation, the barrier face opposite one of the electrodes forming an angle of approximately 45° with the electrode thereby establishing a dielectric barrier between the electrodes along the interior surface of the envelope .

* * * * *